US006854615B2

(12) United States Patent
von Rönn et al.

(10) Patent No.: US 6,854,615 B2
(45) Date of Patent: Feb. 15, 2005

(54) DISPENSING DEVICE

(76) Inventors: Thomas von Rönn, Swinemünder Strasse 46, Hamburg, 22147 (DE); Birgit Clemens, Hermann-Balk-Strasse 117, Hamburg, 22147 (DE)

( * ) Notice: Subject to any disclaimer, the term of this patent is extended or adjusted under 35 U.S.C. 154(b) by 0 days.

(21) Appl. No.: 10/728,667

(22) Filed: Dec. 8, 2003

(65) Prior Publication Data

US 2005/0006386 A1 Jan. 13, 2005

Related U.S. Application Data

(63) Continuation of application No. 10/680,460, filed on Oct. 6, 2003.

(30) Foreign Application Priority Data

Jul. 11, 2003 (DE) ..... 103 31 727

(51) Int. Cl.[7] ..... B65D 51/18
(52) U.S. Cl. ..... 220/253; 222/465
(58) Field of Search ..... 220/253, 254.7–254.9, 220/703, 714, 719, 726, 727; 215/387; 222/465, 519, 486–489

(56) References Cited

U.S. PATENT DOCUMENTS

| | | | | |
|---|---|---|---|---|
| 4,138,033 A | | 2/1979 | Payne et al. | |
| 4,171,060 A | * | 10/1979 | Howard et al. | 220/254.4 |
| 4,440,318 A | | 4/1984 | Berger | |
| 4,523,697 A | | 6/1985 | Jeans | |
| 4,582,218 A | | 4/1986 | Ross | |
| 4,712,704 A | * | 12/1987 | Ramsey et al. | 220/254.4 |
| 4,830,226 A | | 5/1989 | Kong | |
| 5,005,717 A | | 4/1991 | Oilar | |
| 5,035,344 A | | 7/1991 | Christopher | |
| 5,036,994 A | | 8/1991 | McElroy | |
| 5,065,881 A | | 11/1991 | Tarng | |
| 5,102,002 A | | 4/1992 | Whitley | |
| 5,143,248 A | * | 9/1992 | Sawatsky | 220/711 |
| 5,167,354 A | | 12/1992 | Cohanfard | |
| 5,186,353 A | * | 2/1993 | Ramsey | 220/711 |
| 5,217,141 A | | 6/1993 | Ross | |
| 5,222,623 A | | 6/1993 | Eger et al. | |
| 5,288,019 A | | 2/1994 | Gorochow | |
| 5,294,014 A | * | 3/1994 | Wyatt et al. | 220/253 |
| 5,465,866 A | | 11/1995 | Belcastro | |
| 5,515,995 A | * | 5/1996 | Allen et al. | 220/592.16 |
| 5,518,134 A | | 5/1996 | Liu | |
| 5,683,006 A | | 11/1997 | Cook, III | |
| 5,702,020 A | | 12/1997 | Larsen | |
| 5,722,574 A | | 3/1998 | Pratt | |
| 5,749,491 A | | 5/1998 | Wylder et al. | |
| 5,890,621 A | | 4/1999 | Bachman et al. | |

(List continued on next page.)

FOREIGN PATENT DOCUMENTS

DE 199 25 761 12/2000

*Primary Examiner*—Lien Ngo
(74) *Attorney, Agent, or Firm*—Kenyon & Kenyon

(57) ABSTRACT

A dispensing device, such as a drinking container, for selectively dispensing a substance, such as a drinking liquid. The dispensing device includes a container defining a chamber for storing the substance. The dispensing device also includes a lid element. The lid element includes a lower lid portion attachable to the container. The lower lid portion defines at least one lower orifice. The lower lid portion has an upwardly-extending column member located in a center region of the lower lid portion. The lid element also includes an upper lid portion configured to be rotatably mounted on the lower lid portion via the column member. The upper lid portion defines at least one upper orifice. The upper lid portion is rotatable relative to the lower lid portion to a closed position at which the upper orifice is misaligned with the lower orifice. In addition, the upper lid portion is rotatable relative to the lower lid portion to an open position at which the upper orifice is aligned with the lower orifice for dispensing the substance.

15 Claims, 7 Drawing Sheets

U.S. PATENT DOCUMENTS 5,894,948 A 4/1999 Yeh
6,003,711 A 12/1999 Bilewitz
6,010,029 A 1/2000 Wang
6,085,931 A 7/2000 Sadow
6,102,244 A 8/2000 Kuwano et al.
6,220,470 B1 * 4/2001 McHenry et al. ..... 220/254.4
6,290,084 B1 9/2001 Louie
6,290,090 B1 9/2001 Essebaggers
6,352,166 B1 3/2002 Copeland
6,409,038 B1 6/2002 Karp
6,422,415 B1 7/2002 Manganiello
6,502,418 B2 1/2003 Holley, Jr.
6,626,314 B1 * 9/2003 McHenry et al. ..... 220/254.2
6,732,876 B2 * 5/2004 Belcastro ..... 220/253
6,739,471 B2 * 5/2004 Goetz et al. ..... 220/258.4

* cited by examiner

DISPENSING DEVICE

CROSS-REFERENCE TO RELATED APPLICATIONS

This application claims the benefit of foreign priority under 35 U.S.C. §119 of German Patent Application No. 103 31 727.9, filed on Jul. 11, 2003, which is expressly incorporated herein by reference in its entirety. In addition, this application is a continuation of U.S. patent application Ser. No. 10/680,460, which was filed on Oct. 6, 2003, which is expressly incorporated herein in its entirety by reference thereto.

FIELD OF THE INVENTION

The present invention relates to a dispensing device. More specifically, the present invention relates to a dispensing device, such as a drinking container, that is suitable for dispensing carbonated beverages.

BACKGROUND INFORMATION

Various types of drinking containers, and in particular closeable drinking containers, are known. They are generally made up of a cup part having a handle, and an attachable lid element that has two lid portions that are rotatable relative to each other. A pivotable upper lid portion has openings that may be brought into alignment with openings in the lower lid portion, thereby allowing liquid to flow therethrough, or that may be brought out of alignment with each other to prevent liquid from flowing therethrough.

U.S. Pat. No. 4,171,060 describes one type of conventional drinking mug having two diametrically opposed drinking openings. The drinking openings are situated in a lower lid and have sealing covers. The sealing covers are situated below the drinking openings in the receiving chamber of the drinking mug and can swivel into the receiving chamber. More specifically, the sealing covers are swivellable through the drinking openings in the lower lid and into the receiving chamber in which the drinking liquid is stored. In this manner, the sealing covers swivel so as unblock the drinking openings, using bevels that are situated on the upper lid.

German Patent No. DE 199 25 761 A1 describes another type of conventional drinking mug having an insertable upper lid. The insertable upper lid has flow-through openings situated at its edge. The flow-through openings interact with a flat, ring-like rib. The flat, ring-like rib is situated below the upper lid and has two opposite-disposed orifices for allowing liquid to pass through. The rib functions equivalently to a lower lid having a large, centrally situated, circular opening. The upper lid is rotatably supported by a receiving ring, which is situated in the plane of the lid, between the rib and the drinking rim, and interacts with a groove on the edge of the upper lid.

However, these conventional drinking containers have several disadvantages. For instance, many conventional drinking containers are not sufficiently leakproof. Furthermore, many conventional drinking containers, particularly those conventional drinking containers that have upper-lid actuating elements that project out beyond the drinking rim, can not be effectively locked. Consequently, these conventional drinking containers may be opened unintentionally. Still further, these conventional drinking containers are not suitable for carbonated beverages. Specifically, and as illustrated by the drinking container shown and described in U.S. Pat. No. 4,171,060, when a sufficiently large pressure is built up in the chamber of the drinking mug, the upper lid does not adequately seal and can be inadvertently detached or propelled away from the mug in an unchecked manner.

Furthermore, these conventional drinking containers do not provide a satisfactory level of drinking comfort. In particular, most conventional drinking containers have drinking openings positioned on small surfaces, or provide narrow slots or partially-covered openings through which the drinking liquid may be extracted. For instance, and as illustrated by the drinking container shown and described in German Patent No. DE 199 25 761 A1, when the upper lid is in an open, drinking position, the drinking openings remain partially blocked and or covered by the sealing element, thereby hindering the flow of liquid therethrough.

Thus, there is a need for an improved dispensing device, and in particular, an improved dispensing device that is suitable for dispensing carbonated beverages.

SUMMARY OF THE INVENTION

The present invention, according to one example embodiment thereof, relates to a dispensing device, such as a drinking container, for selectively dispensing a substance, such as a drinking liquid, e.g., a carbonated beverage. The dispensing device includes a container defining a chamber for storing the substance. The dispensing device also includes a lid element. The lid element includes a lower lid portion attachable to the container. The lower lid portion defines at least one lower orifice. The lower lid portion has an upwardly-extending column member located in a center region of the lower lid portion. The lid element also includes an upper lid portion configured to be rotatably mounted on the lower lid portion via the column member. The upper lid portion defines at least one upper orifice. The upper lid portion is rotatable relative to the lower lid portion to a closed position at which the upper orifice is misaligned with the lower orifice. In addition, the upper lid portion is rotatable relative to the lower lid portion to an open position at which the upper orifice is aligned with the lower orifice for dispensing the substance.

In one embodiment, the dispensing device includes a control element attachable to the upper lid portion, the control element being movable by a user for controlling the rotation of the upper lid portion relative to the lower lid portion. The control element may be a handle portion that extends beyond an edge of the lid element and that is manipulatable by a thumb of a user. In one embodiment, the dispensing device also includes a sliding element positionable on a top surface of the upper lid portion, the sliding element configured to engage the column member so as to press the upper lid portion towards the lower lid portion. Advantageously, the sliding element has a sloped surface that is configured, upon movement of the sliding element relative to the column member, to gradually engage a corresponding sloping surface of the column member so as to progressively press the upper lid portion more firmly against the lower lid portion. The dispensing device may also include a sealing element between the upper orifice and the lower orifice so as to seal the lid element when in the closed position.

Preferably, the column member includes a base portion and a head portion connected by a neck portion, at least a portion of the neck portion having an outer radial dimension that is smaller than an outer radial dimension of the base portion and the head portion. The sliding element may include a slot that is configured to be received within the neck portion of the column member for maintaining the sliding element in position between the base portion and the head portion such that the upper lid portion is rotatably mounted below the sliding element. In one embodiment, the head portion, a central opening of the upper lid portion and the slot of the sliding element have corresponding shapes, such that the head portion is insertable through the central opening of the upper lid portion and such that the sliding element is moveable upwardly (or downwardly) relative to the head portion when the sliding element is in a first rotational position relative to the lower lid portion, but is not moveable upwardly (or downwardly) relative to the head portion when the sliding element is rotated away from the first rotational position. In this manner, the upper lid portion is prevented from being axially propelled away from the lower lid portion by pressure stored in the chamber, particularly when the upper lid portion is rotated between the closed position and the open position.

BRIEF DESCRIPTION OF THE DRAWINGS

FIG. 5(*b*) is a top view of the lower lid portion illustrated in FIG. 5(*a*);

FIG. 6(*b*) is a side view of the column member illustrated in FIG. 6(*a*);

FIG. 6(*c*) is a top view of the column member illustrated in FIGS. 6(*a*) and 6(*b*);

FIG. 8(*b*) is a side, cross-sectional view of a portion of the sliding element illustrated in FIG. 8(*a*);

FIG. 8(*c*) is a top view of the sliding element illustrated in FIGS. 8(*a*) and 8(*b*);

FIG. 9(*b*) is a side, cross-sectional view of the upper lid portion illustrated in FIG. 9(*a*);

FIG. 9(*c*) is a top view of the upper lid portion illustrated in FIGS. 9(*a*) and 9(*b*);

DETAILED DESCRIPTION

The present invention relates to a dispensing device for dispensing a substance. According to one embodiment of the present invention, the dispensing device is a drinking container that is configured to dispense a drinking liquid. As set forth more fully below, the dispensing device may be preferably a drinking container that is particularly suitable for dispensing a carbonated drinking liquid, such as a soda. It should be recognized, however, that while the examples of a dispensing device are described hereinbelow in connection with a drinking container for dispensing a drinking liquid, the dispensing device may dispense any type of substance that is capable of being, e.g., poured or shaken, out of the dispensing device, including by way of non-limiting example, sugar, salt, pepper, honey, etc.

Figure 1:
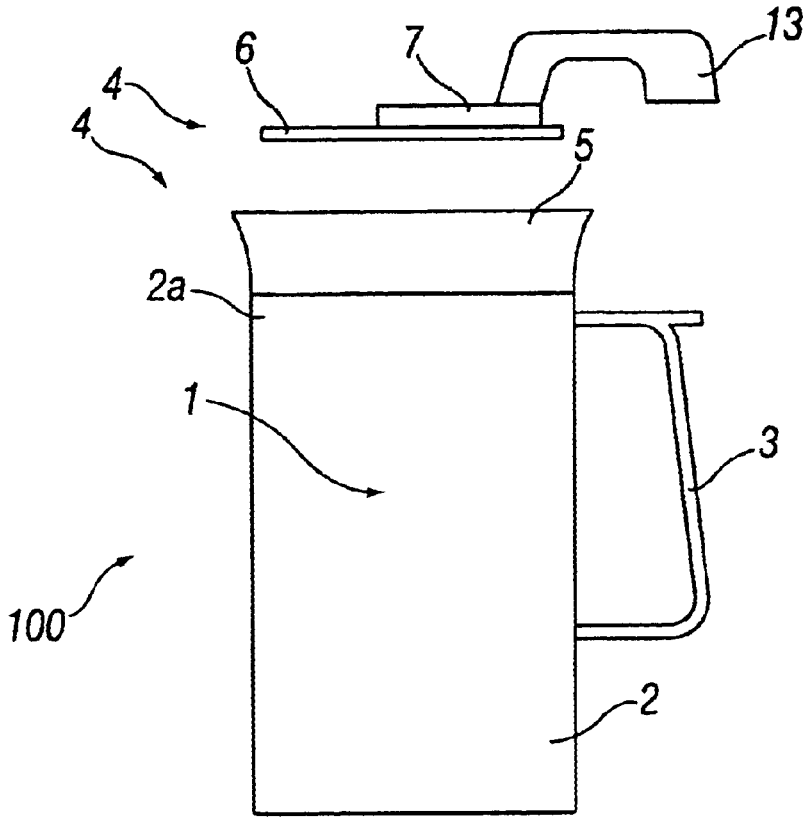
FIG. 1 is an exploded, side view that illustrates a dispensing device, according to one embodiment of the present invention.

FIG. 1 is an exploded or unassembled, side view that illustrates a dispensing device 100, according to one embodiment of the present invention. The dispensing device 100 shown in FIG. 1 includes a container 2 defining therein a chamber 1. The container 2 may be any type of container, including by way of non-limiting example, an insulating mug having a double-walled construction. The container 2 may have any size or shape, including by way of non-limiting example, a size and shape that enables the dispensing device 100 to be accommodated in a cup holder or the like.

The dispensing device 100 has a laterally attached handle portion 3. The dispensing device 100 also includes a lid element 4 that is attachable to a top rim 2*a* of the container 2. The lid element 4 may be attachable to the top rim 2*a* of the container 2 in any known manner, for instance by a threaded or form-locked engagement. Preferably, the lid element 4 is attachable to the top rim 2*a* of the container 2 so as to be sealed relative to the top rim 2*a* of the container 2. It should be recognized, however, that while the lid element 4 is shown in FIG. 1 as being attached to the top rim 2*a* of the container 2, the lid element 4 is described above as being attachable to the top rim 2*a* of the container 2, such that, in other embodiments, the lid element 4 is a separate and discrete device in and of itself that may be selectively attached to various different containers.

The lid element 4 includes a lower lid portion 5, which is preferably formed in the shape of a cup. The lid element 4 also includes an upper lid portion 6 and a slide element 7. A control element 13, in the shape of a handle portion, extends radially beyond an edge of the lid element, the control element 13 being manipulatable by, e.g., a thumb of a user.

Figure 2:
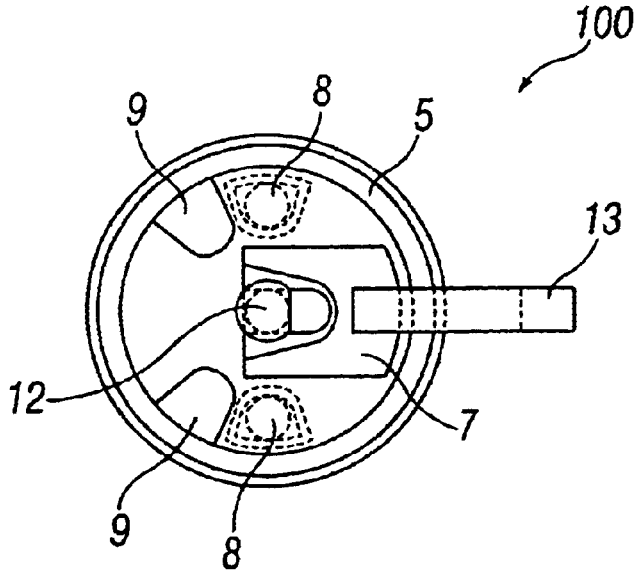
FIG. 2 is a top view of the dd illustrated in FIG. 1.

FIG. 2 is a top view of the dispensing device 100 illustrated in FIG. 1. At least one lower orifice, but preferably two lower orifices BR and 8L, which are indicated here by hidden lines, are defined by and formed in the lower lid portion 5. In addition, at least one upper orifice, but preferably two upper orifices 9R and 9L, are defined by and formed in the upper lid portion 6. The lower lid portion 5 also includes an upwardly-extending column member 12 located in a center region of the lower lid portion 5. As set forth more fully below, the upper lid portion 6 is rotatable around the column member 12 relative to the lower lid portion 5 to a closed position at which the upper orifices 9R and 9L are misaligned with the lower orifices 8R and 8L, respectively, and at which the upper orifices 9R and 9L are aligned with sealing elements 21, shown here as hidden lines, mounted within the upper lid portion 6. In addition, the upper lid portion 5 is rotatable relative to the lower lid portion 6 to an open position. For instance, the upper lid portion 5 may be rotatable in a first direction relative to the lower lid portion 6 to a first open position at which the upper orifice 9R is aligned with the lower orifice 8R for dispensing the substance stored in the chamber 1. This first open position corresponds to a position that might advantageously be employed by a right-handed individual when using the dispensing device 100. Additionally or alternatively, the upper lid portion 5 may be rotatable in a second direction relative to the lower lid portion 6 to a second open position at which the upper orifice 9L is aligned with the lower orifice 8L for dispensing the substance stored in the chamber 1. This second open position corresponds to a position that might advantageously be employed by a left-handed individual when using the dispensing device 100. In one embodiment, the lid element 4 is configured such that rotation of the upper lid portion 6 via the control element 13 by 40° in a counter-clockwise direction relative to the closed position causes the lower orifice 8R and the upper orifice 9R to be aligned. Likewise, in one embodiment, the lid element 4 is configured such that rotation of the upper lid portion 6 via the control element 13 by 40° in a clockwise direction relative to the closed position causes the lower orifice 8L and the upper orifice 9L to be aligned.

Figure 3:
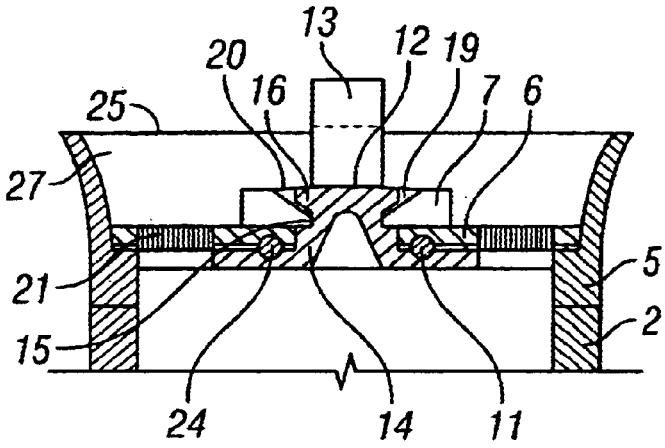
FIG. 3 is a side cross-sectional view of the dd illustrated in FIGS. 1 and 2.

FIG. 3 is a side cross-sectional view of the dispensing device 100 illustrated in FIGS. 1 and 2. As shown in FIG. 3, the column member 12 includes a base portion 11 including a shoulder 14. In addition, the column member 12 includes a head portion 16. The base portion 11 and the head portion 16 of the column member 12 are connected by a neck portion 15. At least a portion of the neck portion 15 has an outer radial dimension that is smaller than an outer radial dimension of the base portion 11 and the head portion 16. The upper lid portion 6 is configured to be rotatably mounted between the base portion 11 and the head portion 16, and more specifically, to be rotatably mounted on a top surface of the base portion 11 adjacent to the shoulder 14.

The sliding element 7 includes a slot 18 that is open on one side and that is configured to be received within the neck portion 15 of the column member 12 for maintaining the sliding element 7 in position between the base portion 11 and the head portion 16.

Thus, when assembled, the upper lid portion 6 is configured to be rotatably mounted between the lower lid portion 5 and the sliding element 7, such that the upper lid portion 6 and the sliding element 7 are maintained below the head portion 16.

FIG. 3 also illustrates the seal element 21 that is mounted within the upper lid portion 6 for providing a seal between the lower orifices 8R and 8L of the lower lid portion 5 and the upper orifices 9R and 9L of the upper lid portion 6. In addition, a spring element 24 may be disposed between the lower lid portion 5 and the upper lid portion 6 for biasing the upper lid portion 6 away from the lower lid portion 5 when the upper lid portion 5 is not in a closed position. FIG. 3 also illustrates one arrangement of the lower lid portion 5 in which the lower lid portion 5 includes a side wall 27 that extends upwardly, and preferably slightly radially outwardly, to a rim 25. In this manner, the rim 25 closely approximates the drinking rim of a conventional mug or cup, such that the dispensing device 100 may provide an experience that closely approximates drinking from a conventional mug or cup. FIG. 3 also illustrates that the sliding element 7 includes a sloped surface 19 that is adjacent to the slot 18. The sloped surface 19 of the sliding element 7 engages a sloped surface 20 located on an exposed bottom surface of the head portion 16.

Figure 4:
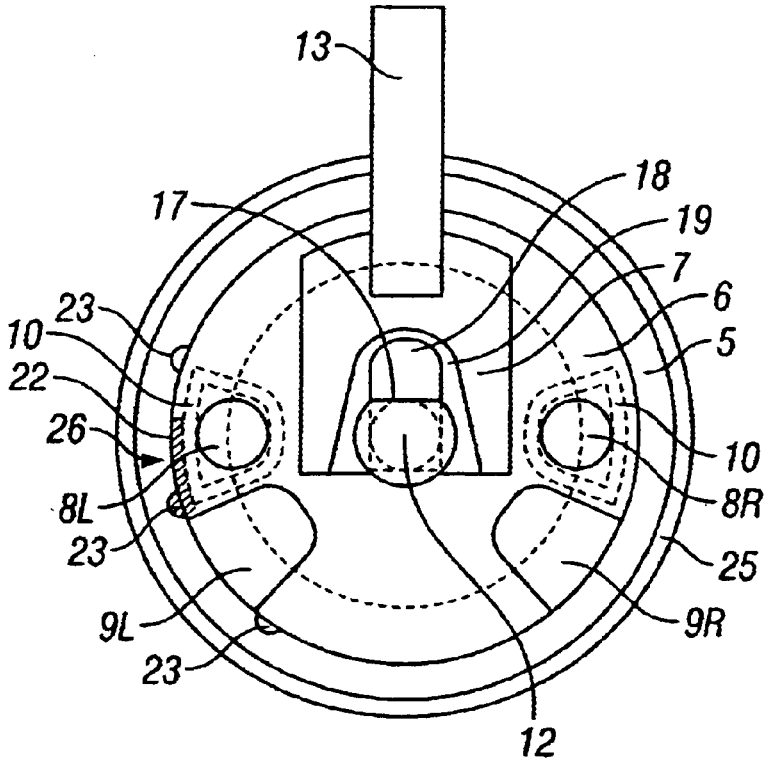
FIG. 4 is a more detailed top view of the dd illustrated in FIGS. 1 to 3.

FIG. 4 is a top view of the dispensing device 100 illustrated in FIGS. 1 to 3, that more clearly shows some of the features thereof. For instance, FIG. 4 illustrates the head portion 16 of the column member 12 having a shape when viewed from the top, such as a truncated circular shape, e.g., a modified circle having at least one, but preferably two, flat or key surfaces 17. In addition, the upper lid portion 6 defines a central opening 6*a* having a shape that corresponds to the shape of the head portion 16, such that the head portion 16 is insertable through the central opening 6*a* of the upper lid portion 6. In addition, the slot 18 of the sliding element 7 has a shape that corresponds to the shape of the head portion 16 and the neck portion 15 of the column member 12.

Thus, in order to assemble the lid element 4, the head portion 16 of the column member 12 is inserted through the central opening 6*a* of the upper lid portion 6 so that the upper lid portion 6 rests adjacent to the base portion 11. The sliding element 7 is then positioned so that the open end of the slot 18 of the sliding element 7 is received in the neck portion 15 of the column member 12. The sliding member 7 is then moved towards the center of the upper lid portion 6, such that the sloped surface 19 of the sliding element 7 gradually and progressively engages the sloped surface 20 of the head portion 16. Due to the sloped surface 19 of the sliding element 7 gradually and progressively engaging the sloped surface 20 of the head portion 16, the upper lid portion 6 is pressed gradually and progressively more firmly onto the lower lid portion, thereby ensuring an adequate seal between the lower lid portion 5 and the upper lid portion 6.

The lid element 4 is configured such that, when assembled, the upper lid portion 6 is prevented from being inadvertently propelled away from the lower lid portion by pressure stored in the chamber 1. Specifically, the lid element 4 may be configured such that, when sliding element 7 is in a first rotational position relative to the lower lid portion 6, e.g., in a position at which the flat key surfaces 17 of the head portion 16 of the column member 12 are aligned with the slot 18 of the siding member 7, the sliding element 7 is moveable upwardly relative to the lower lid portion 5, thereby enabling the upper lid portion 6 to be lifted away from the lower lid portion 5, such as for cleaning purposes. Furthermore, the lid element 4 may be configured such that, when sliding element 7 is in any position other than the first rotational position relative to the lower lid portion 6, e.g., when the sliding element is in a position at which the flat key surfaces 17 of the head portion 16 of the column member 12 are not aligned with the slot 18 of the siding member 7, the sliding element 7 is not moveable upwardly relative to the lower lid portion 5, thereby preventing the upper lid portion 6 from being inadvertently lifted or propelled away from the lower lid portion 5, e.g., by pressure stored in the chamber 1.

FIG. 4 also illustrates each of the upper lid portion 5 and the lower lid portion 6 having corresponding rotational position indication elements for indicating when the upper lid portion 6 is in the open and closed positions. For instance, FIG. 4 illustrates the upper lid portion 6 having a radial projection 26 located on the outer circumference of the upper lid portion 6 that is configured to engage one or more projection receiving opening 23 located on the inner radial surface of the lower lid portion 5. FIG. 4 shows the lower lid portion 5 having three different projection receiving openings 23, corresponding to a first open position, a second open position and a closed position, respectively. As previously indicated, in one embodiment, the outer projection receiving openings 23 corresponding to each of the first and second open positions are located 40 degrees clockwise and counter-clockwise, respectively, to the central projection receiving opening 23 corresponding to the closed position. The rotational position indication elements 23, 26 are configured to selectively, e.g., temporarily, fix the upper lid portion 6 in one of the open and closed positions.

FIGS. 5 to 10 illustrate various unassembled components of a dispensing device 200, in accordance with another embodiment of the present invention. For instance, FIG.

Figure 5A:
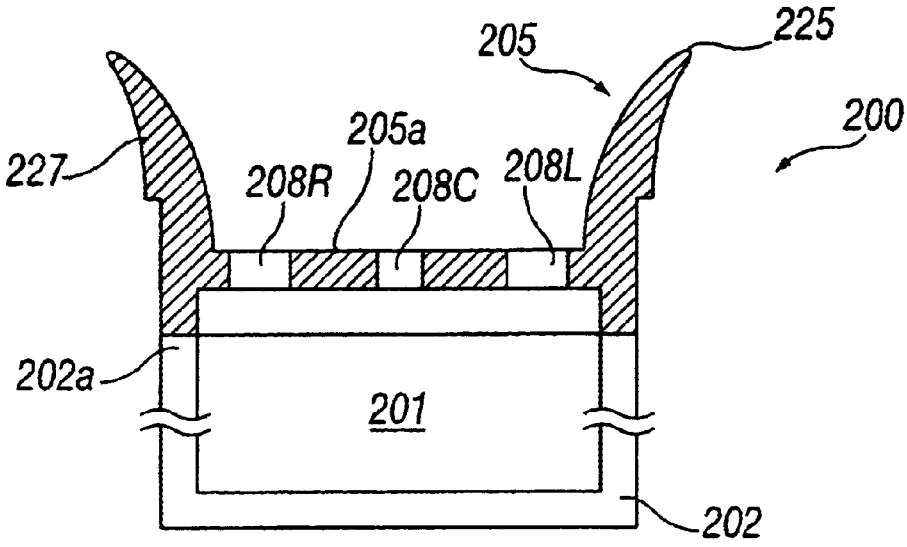
FIG. 5(*a*) is a side, cross-sectional view that illustrates a lower lid portion of a dispensing device, according to one embodiment of the present invention.
Figure 5B:
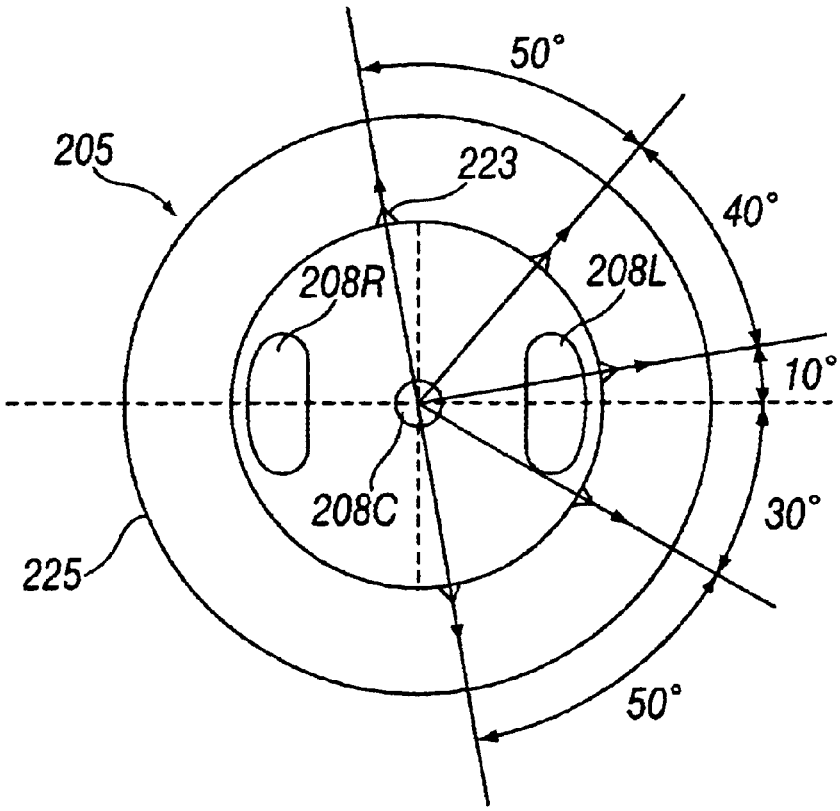

5(*a*) is a side, cross-sectional view, and FIG. 5(*b*) is a top view, that illustrate a lower lid portion 205 of a dispensing device 200, according to one embodiment of the present invention, that is attachable to a container 202 in any known manner. At least one lower orifice, but preferably two lower orifices 208R and 208L, are defined by and formed in the lower lid portion 205. The lower lid portion 205 is preferably formed in the shape of a cup, such that the lower lid portion 205 includes a side wall 227 that extends upwardly, and preferably slightly radially outwardly, to a rim 225. In this manner, the rim 225 closely approximates the drinking rim of a conventional mug or cup, thereby providing a user of the dispensing device 200 with an experience that closely approximates drinking from a conventional mug or cup. The lower lid portion 205 also includes an orifice 208C that is disposed in the center of the lower lid portion 205.

As best shown in FIG. 5(*b*), the lower lid portion 205 also includes projection receiving openings 223 located on the inner radial surface of the lower lid portion 5, that are configured to engage with a projection 226 of the upper lid portion 206, which is described more fully below. FIG. 5(*b*) shows the lower lid portion 5 having five different projection receiving openings 223. Three of these openings 223 correspond to a first open position, a second open position and a dosed position, respectively. In addition, the two outermost openings 223 correspond to disconnection positions, e.g., positions at which, due to the shape of the slot 218 of the sliding element 207 and the shape of the head portion 216 of the column member 212, the upper lid portion 206 is able to be disconnected from the lower lid portion 205. In this manner, a user of the dispensing device 200 may more readily locate the disconnection position.

Figure 6A:
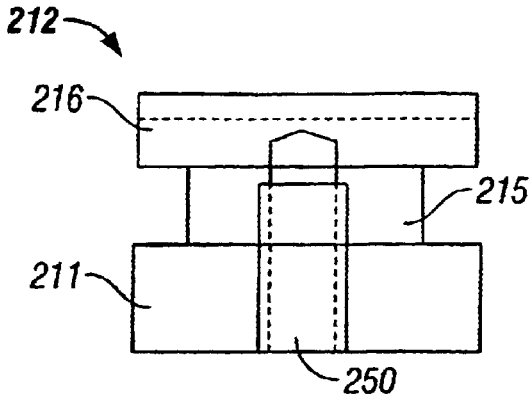
FIG. 6(*a*) is a front view of a column member, in accordance with one embodiment of the invention.
Figure 6B:
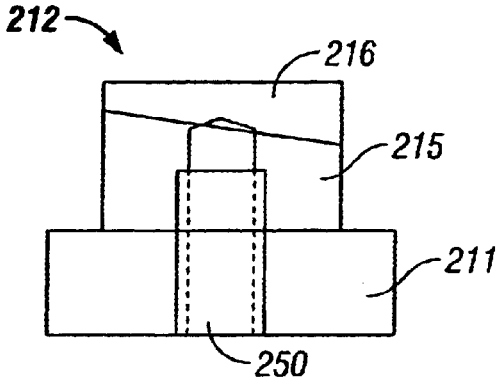
Figure 6C:
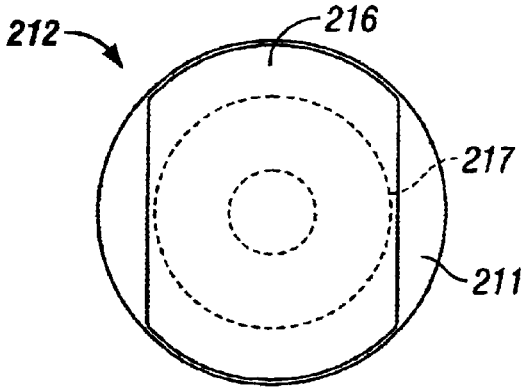

FIG. 6(*a*) is a front view of a column member 212, in accordance with one embodiment of the invention. FIG. 6(*b*) is a side view of the column member 212 illustrated in FIG. 6(*a*), while FIG. 6(*c*) is a top view of the column member 212 illustrated in FIGS. 6(*a*) and 6(*b*). The column member 212 includes the base portion 211. The column member 212 also includes a shoulder 214 formed by the base portion 211. In addition, the column member 212 includes a head portion 216. The base portion 211 and the head portion 216 of the column member 212 are connected by a neck portion 215. At least a portion of the neck portion 215 has an outer radial dimension that is smaller than an outer radial dimension of the base portion 211 and the head portion 216. As best shown in FIG. 6(*b*), an exposed bottom surface of the head portion 216 forms a sloped surface 220, which preferably has a slope of approximately 10 degrees. Furthermore, as best shown in FIG. 6(*c*), the head portion 216 of the column member 212 has a shape when viewed from the top, such as a truncated circular shape, e.g., a modified circle having at least one, but preferably two, flat or key surfaces 17.

Figure 7:
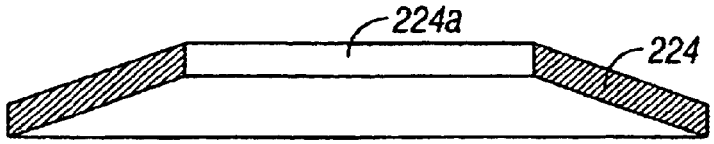
FIG. 7 illustrates a spring element, in accordance with one embodiment of the invention.

FIG. 7 illustrates a spring element 224 having a centrally disposed orifice 224*a*, in accordance with one embodiment of the invention.

Figure 8A:
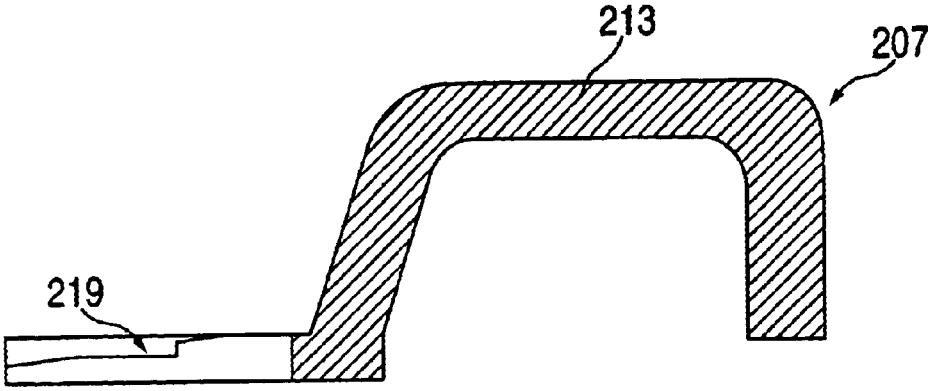
FIG. 8(*a*) is a side view of a sliding element, in accordance with one embodiment of the invention.
Figure 8B:
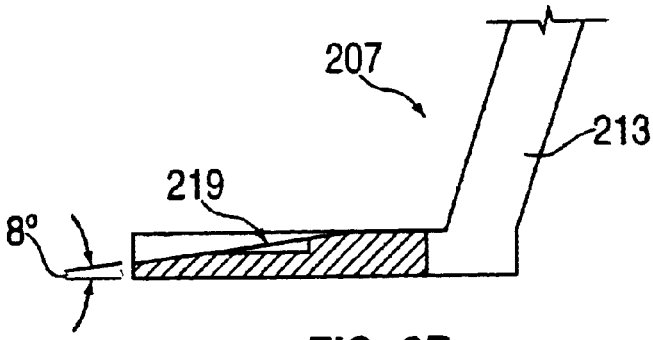
Figure 8C:
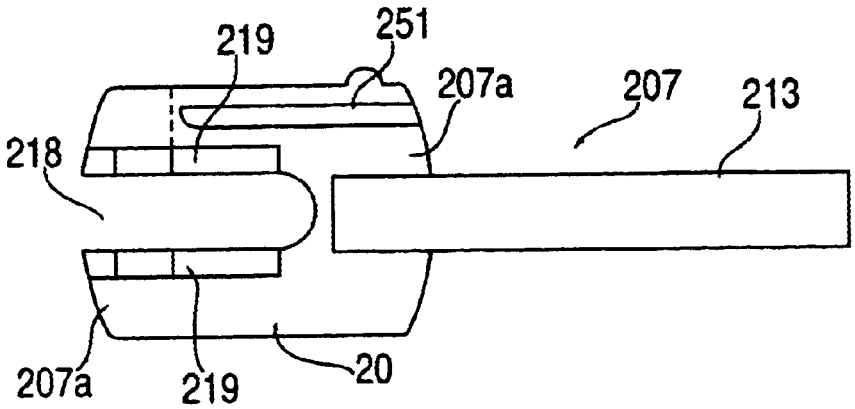

FIG. 8(*a*) is a side view of a sliding element 207, in accordance with one embodiment of the invention. FIG. 8(*b*) is a side, cross-sectional view of a portion of the sliding element 207 illustrated in FIG. 8(*a*), while FIG. 8(*c*) is a top view of the sliding element 207 illustrated in FIGS. 8(*a*) and 8(*b*). The sliding element 207 includes a control element 213, in the shape of a handle portion, that is configured to extend radially beyond an edge of the lid element, the control element 213 being manipulatable by, e.g., a thumb of a user. As best shown in FIG. 8(*c*), the sliding element 207 includes a slot 218 that is open on one side and that is configured to be received within the neck portion 215 of the column member 212 for maintaining the sliding element 207 in position between the base portion 211 and the head portion 216. The sliding element 207 also includes a pair of parallel-disposed, sloped surfaces 219 positioned adjacently to the slot 218. The sloped surfaces 219 preferably have a slope of approximately 8 degrees. The sloped surfaces 219 are surrounded by a body portion 207*a*, that is essentially flat. On one side of the body portion 207*a*, the sliding element 207 has a sliding element position indication element, e.g., a projection 251 that is biased away from the body portion 207*a*.

Figure 9A:
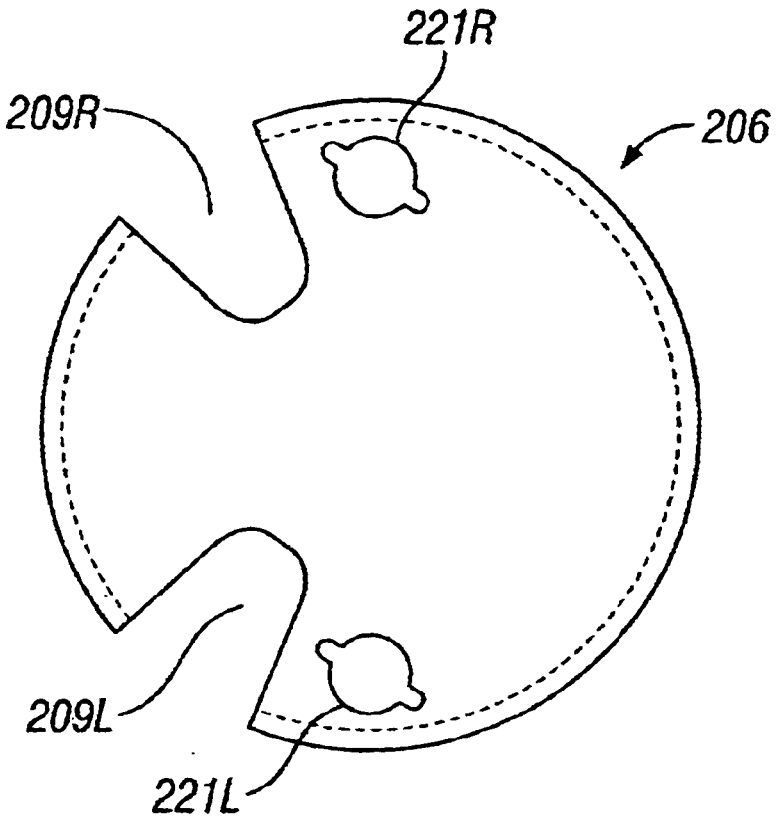
FIG. 9(*a*) is a bottom view of an upper lid portion, in accordance with one embodiment of the invention.
Figure 9B:
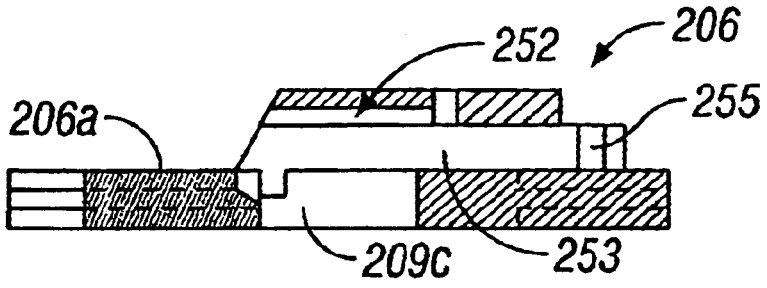
Figure 9C:
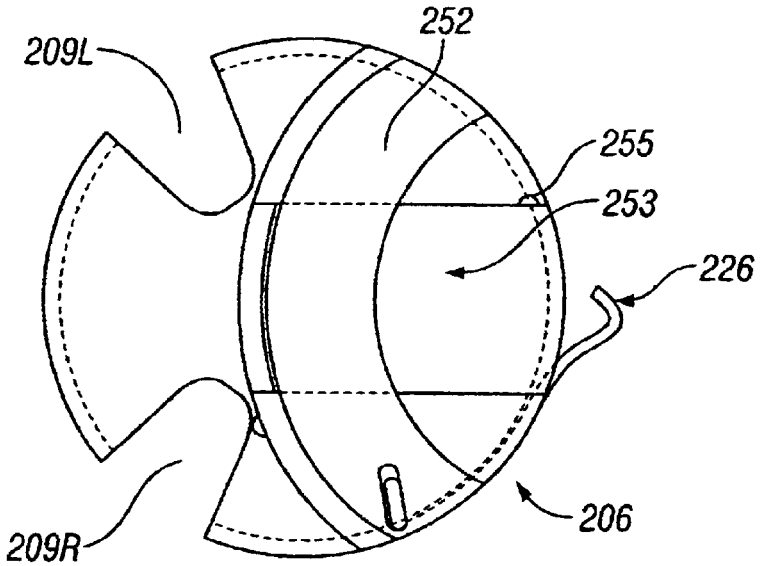
Figure 10:
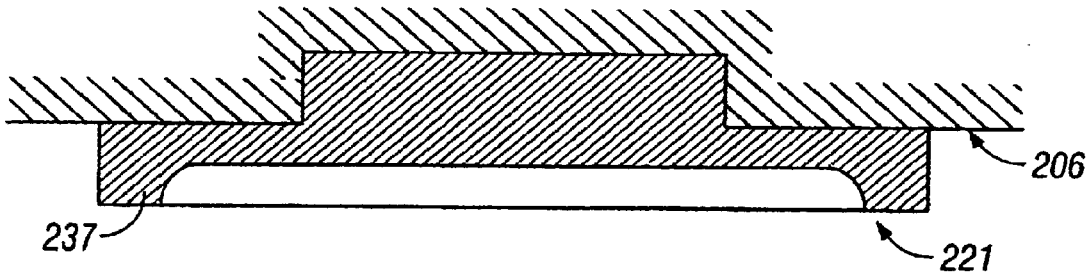
FIG. 10 is a cross-sectional side view of a sealing element, according to one embodiment of the present invention.

FIG. 9(*a*) is a bottom view of an upper lid portion 206, in accordance with one embodiment of the invention. FIG. 9(*b*) is a side, cross-sectional view of the upper lid portion 206 illustrated in FIG. 9(*a*), while FIG. 9(*c*) is a top view of the upper lid portion 206 illustrated in FIGS. 9(*a*) and 9(*b*). At least one upper orifice, but preferably two upper orifices 209R and 209L, are defined by and formed in the upper lid portion 206. The upper lid portion 206 also defines a central orifice 209C. As shown in FIG. 9(*a*), the upper lid portion 206 also includes at least one sealing element, but preferably two sealing elements 221, located adjacent to the two upper orifices 209R and 209L. A cross-sectional side view of a sealing element 221, having a seating rim 237 for improved seating, according to one embodiment of the present invention, is shown in FIG. 10. Referring to FIGS. 9(*b*) and 9(*c*), the upper lid portion 206 also includes a bridge wall 252 that extends over at least a portion of a top surface 206*a* of the upper lid portion 206 for providing additional structural rigidity to the upper lid portion 206. In the space between the top surface 206*a* of the upper lid portion 206 and a bottom surface of the bridgewall 252 there is disposed a slot 253 that is configured to slidably receive the sliding element 207. The upper lid portion 206 also includes a projection receiving opening 255 that is configured to register with the biased projection 251 of the sliding element 207 when the sliding element 207 is fully inserted into the slot 253. As previously mentioned, the upper lid portion 6 also has a radial projection 226 located on the outer circumference of the upper lid portion 6 that functions as a rotational position indication element for indicating when the upper lid portion 6 is in, e.g., the open and closed positions. Specifically, the radial projection 226 of the upper lid portion 206 is configured to selectively engage one of several, e.g., five, projection receiving openings 223 located on the inner radial surface of the lower lid portion 205 for selectively, e.g., temporarily, fixing the upper lid portion 206 in a desired position relative to the lower lid portion 205.

To assemble the lid element 204, the base portion 211 of the column member 212 of FIGS. 6(*a*) to 6(*c*) is inserted into the corresponding opening 224*a* of the spring element 224 of FIG. 7. The column member 212 is then attached to a top surface 205*a* of the lower lid portion 205 shown in FIGS. 5(*a*) and 5(*b*), for example by a screw or bolt extending through orifice 208C of the lower lid portion 205 and into an internal bore 250 of the column member 212. The head portion 216 of the column member 212 is then inserted through the central opening 209C of the upper lid portion 206 shown in FIGS. 9(*a*) to 9(*c*). The head portion 216 extends into the slot 253 of the upper lid portion 206. The sliding element 207 shown in FIGS. 8(*a*) to 8(*c*) is then inserted into the slot 253 of the upper lid portion 206 and the sloped surfaces 219 of the sliding element 207 engage the sloped surface 220 of the head portion 216. The arrangement described hereinabove provides for a relatively large contact surface between the sloped surfaces 219 of the sliding element 207 and the sloped surface 220 of the head portion 216. As the sliding element 207 is pushed further into the slot 253 of the upper lid portion 206, the engagement of the sloped surfaces 219 and 220 causes the sliding element to be gradually and progressively pressed against the upper lid portion 206, and consequently causes the upper lid portion 206 to be gradually and progressively pressed down onto the lower lid portion 205. In the embodiment described above, the disparity between the slopes of the sloped surfaces 219 and 220, e.g., the sloped surface 219 of the sliding element 207 has a slope of 8 degrees and the sloped surface 220 of the head portion 216 has a slope of 10 degrees, may provide an initial stress on the upper lid portion 206 that ensures more effective seating of the sealing elements 221 during operation. The sliding element 207 is pushed into the slot 253 of the upper lid portion 206 until the projection 251 of the sliding element registers with the projection receiving opening 255 of the upper lid portion 206 to indicate that the sliding element 207 is fully inserted into the slot 253.

As set forth more fully above, during operation, the upper lid portion 206 is rotatable around the column member 212 relative to the lower lid portion 205 to a closed position at which the upper orifices 209R and 209L are misaligned with the lower orifices 208R and 208L, respectively, and at which the upper orifices 209R and 209L are aligned with the sealing elements 221 of the upper lid portion 206. In addition, the upper lid portion 205 is rotatable relative to the lower lid portion 206 to one or more open positions. For instance, the upper lid portion 205 may be rotatable in a first direction relative to the lower lid portion 206 to a first open position at which the upper orifice 209R is aligned with the lower orifice 208R for dispensing the substance stored in the chamber 201. This first open position corresponds to a position that might advantageously be employed by a right-handed individual when using the dispensing device 200. Additionally or alternatively, the upper lid portion 205 may be rotatable in a second direction relative to the lower lid portion 206 to a second open position at which the upper orifice 209L is aligned with the lower orifice 208L for dispensing the substance stored in the chamber 201. This second open position corresponds to a position that might advantageously be employed by a left-handed individual when using the dispensing device 200. In one embodiment, and as shown in FIG. 5(*b*), the lid element 204 may be configured such that rotation of the upper lid portion 206 via the control element 213 by 40° in a counterclockwise direction causes the lower orifice 208R and the upper orifice 209R to be aligned. Likewise, the lid element 204 may be configured such that rotation of the upper lid portion 206 via the control element 213 by 40° in a clockwise direction causes the lower orifice 208L and the upper orifice 209L to be aligned. Still further, the lid element 204 may be configured such that the upper lid portion 206 is able to be disconnected from the lower lid portion 205 when the upper lid portion 206 is rotated an additional 50 degrees past each one of the first and second open positions, respectively. In this manner, rotation of the upper lid portion 206 relative to the lower lid portion 205 by a user between the closed position and either of the open positions will not result in the upper lid portion 206 being propelled away from the lower lid portion 205 by pressure that may exist in the chamber 201, because the disconnection positions are located at a substantial distance from either of the open positions.

Thus, the present invention provides a dispensing device, e.g., a drinking container, which maybe reliably sealed, even when a reasonably large amount of pressure builds up in the chamber. Furthermore, the present invention provides a dispensing device that allows reliable and simple handling, that is lockable, that is easy to clean, and that allows the user to comfortably extract the drinking liquid in a manner that approaches drinking from a customary, mug-like drinking container.

Still further, according to the present invention, the dispensing device provides an arrangement in which the fastening elements of the upper lid portion are reduced to a minimum, and are positioned so as not to interfere or encroach upon the region near to the drinking rim. In this manner, the flow of the stored substance, e.g., a drinking liquid, is minimally interfered with and is regulated only the shape of the lower and upper orifices. In addition, according to the present invention, the dispensing device provides an arrangement which allows user-friendly, one-handed operation with regard to the functions of opening, closing, and locking. Furthermore, according to the present invention, the dispensing device provides an arrangement which is particularly easy to clean, because all of the components that are employed for opening and closing the dispensing device are situated outside of the chamber, and because there are a small number of different components.

In addition, according to the present invention, the dispensing device provides an improved arrangement for withstanding a high pressure built up in the chamber. Specifically, since the upper lid portion is centrally mounted to the lower lid portion by the column member, the outer edges of the upper lid portion are less likely to become deflected or warped by the pressure, and therefore is less likely to become inadvertently disconnected or propelled away from the lower lid portion.

In addition, according to the present invention, the dispensing device provides an arrangement whereby a small force that is used to move the sliding member provides a relatively large sealing force between the upper lid portion and the lower lid portion. The slide also provides the advantage of being lockable by virtue of the self-locking action of, e.g., the sloped surfaces. Furthermore, the position indication elements of the dispensing device that act on the upper lid portion and the lower lid portion provide a user with an easy and reliable method of adjusting the lid positions. In addition, the spring element is positioned in such a manner, that, when the sliding element is not in the dosed position, the upper lid portion is biased away from and lifted off of the lower lid portion, enabling the upper lid portion to be rotated relative to the lower lid portion more easily, and enabling the sealing elements to be released more effectively.

In addition, according to the present invention, the dispensing device provides an arrangement that maximizes drinking comfort. For instance, the arrangements shown and described hereinabove of the sealing surfaces and the lower and upper orifices, e.g., positioned such that the orifices are opened by rotation of the upper lid portion by 40° in either the clockwise or counter-clockwise direction, enable the orifices to be large enough to provide a sufficient flow therethrough without requiring that the control mechanism, e.g., the handle portion, be rotated by a very large amount. Furthermore, in the embodiments shown, the trapezoidal shape of the upper and lower orifices provide for an optimal cross-sectional area for permitting the flow of substances such as a drinking liquid.

Thus, the several aforementioned objects and advantages of the present invention are most effectively attained. Those skilled in the art will appreciate that numerous modifications of the exemplary example embodiments described hereinabove may be made without departing from the spirit and scope of the invention. Although various exemplary example embodiments of the present invention have been described and disclosed in detail herein, it should be understood that this invention is in no sense limited thereby and that its scope is to be determined by that of the appended claims.

What is claimed is:

1. A device for selectively dispensing a liquid comprising:

a container defining a chamber for storing the liquid;

a lid element including:

a lower lid portion attachable to the container, the lower lid portion defining two lower orifices, the lower lid portion having an upwardly-extending column member located in a center region of the lower lid portion, the column member having a sloping surface;

an upper lid portion configured to be rotatably mounted on the lower lid portion via the column member, the upper lid portion defining two upper orifices, wherein the upper lid portion is rotatable relative to the lower lid portion to a closed position at which both upper orifices are misaligned with both lower orifices, and wherein the upper lid portion is rotatable relative to the lower lid portion to a first open position at which a first one of the upper orifices is aligned with a first one of the lower orifices for dispensing the substance and to a second open position at which a second one of the upper orifices is aligned with a second one of the lower orifices for dispensing the substance;

a sliding element positionable on a top surface of the upper lid portion, wherein the sliding element has a sloped surface that is configured, upon movement of the sliding element relative to the column member, to gradually engage the sloping surface of the column member so as to progressively press the upper lid portion towards the lower lid portion.

2. The device of claim 1, further comprising a control element attachable to the upper lid portion, the control element being movable by a user for controlling the rotation of the upper lid portion relative to the lower lid portion.

3. The device of claim 1, wherein the control element is a handle portion that extends beyond an edge of the lid element, the handle portion being manipulatable by a thumb of a user.

4. The device of claim 1, wherein the lower lid portion includes a base over which the upper lid portion rotates and a side wall that extends upwardly to a rim.

5. The device of claim 1, further comprising a sealing element between the upper orifice and the lower orifice so as to seal the lid element when in the closed position.

6. The device of claim 1, wherein the column member includes a base portion and a head portion connected by a neck portion, at least a portion of the neck portion having an outer radial dimension that is smaller than an outer radial dimension of the base portion and the head portion, wherein the upper lid portion is configured to be rotatably mounted below the head portion.

7. The device of claim 6, wherein the sliding element includes a slot that is configured to be received within the neck portion of the column member for maintaining the sliding element in position between the base portion and the head portion, wherein the upper lid portion is configured to be rotatably mounted below the sliding element.

8. The device of claim 7, wherein the upper lid portion defines a central opening, such that the head portion is insertable through the central opening of the upper lid portion and such that the sliding element is axially moveable relative to the head portion when the sliding element is in a first rotational position relative to the lower lid portion.

9. The device of claim 8, wherein the upper lid portion and the sliding element are maintained by the head portion in the neck portion of the column member when the sliding element is rotated away from the first rotational position.

10. The device of claim 9, wherein the first rotational position is positioned so as to prevent the upper lid portion from being axially propelled from the lower lid portion by pressure stored in the chamber when the upper lid portion is rotated between the closed position and the first and second open positions.

11. The device of claim 10, wherein the upper lid portion has a bridgewall that extends over at least a portion of a top surface of the upper lid portion.

12. The device of claim 11, wherein the upper lid portion defines, in a space between a top surface of the upper lid portion and a bottom surface of the bridgewall, a slot configured to receive the sliding element.

13. The device of claim 12, wherein the sliding element includes a biased sliding element position indication tab that is configured to register with a tab receiving opening of the upper lid portion when the sliding element is fully inserted in the slot.

14. The device of claim 13, wherein the upper lid portion and the lower lid portion have corresponding rotational position indication elements for indicating when the upper lid portion is in one of an open position, a closed position and the first rotational position.

15. The device of claim 14, wherein the rotational position indication elements include a radial projection located on one of the upper lid portion and the lower lid portion and a projection receiving opening located on the other of the upper lid portion and the lower lid portion, the rotational position indication elements configured to selectively fix the upper lid portion in one of the open and closed positions.

* * * * *